US011878218B1

(12) United States Patent
Eleutério

(10) Patent No.: US 11,878,218 B1
(45) Date of Patent: Jan. 23, 2024

(54) BALL HAVING A TAPERED PROFILE AND INTEGRATED TUNNEL

(71) Applicant: AZOREAN FL, UNIPESSOAL LDA, Atalhada (PT)

(72) Inventor: Luís Ricardo Correia Do Rego Soares Eleutério, Atalhada (PT)

(73) Assignee: AZOREAN FL, UNIPESSOAL LDA, Atalhada (PT)

( * ) Notice: Subject to any disclaimer, the term of this patent is extended or adjusted under 35 U.S.C. 154(b) by 0 days.

(21) Appl. No.: 17/965,695

(22) Filed: Oct. 13, 2022

(30) Foreign Application Priority Data

Sep. 6, 2022 (PT) ..... 20221000003347

(51) Int. Cl.
*A63B 43/00* (2006.01)
*A63B 41/02* (2006.01)

(52) U.S. Cl.
CPC ..... *A63B 43/002* (2013.01); *A63B 41/02* (2013.01)

(58) Field of Classification Search
CPC ..... A63B 41/08; A63B 43/002; A63B 41/02
See application file for complete search history.

(56) References Cited

U.S. PATENT DOCUMENTS 3,264,776 A * 8/1966 Morrow ..... A63H 33/18 473/589
3,884,466 A * 5/1975 MacDonald ..... A63B 43/002 273/DIG. 20
3,982,489 A * 9/1976 Flatau ..... F42B 10/36 473/588
4,003,574 A * 1/1977 MacDonald ..... A63B 39/00 273/DIG. 20
4,736,948 A * 4/1988 Thomas ..... A63B 43/002 473/613
5,000,451 A * 3/1991 MacDonald ..... A63B 43/00 273/DIG. 20
5,123,645 A * 6/1992 MacDonald ..... A63B 43/002 273/DIG. 20
5,306,191 A * 4/1994 Phillips ..... A63H 27/005 446/61
5,450,979 A * 9/1995 Servick ..... F25D 3/08 206/217
5,458,329 A * 10/1995 Bushman ..... A63B 43/002 273/DIG. 8
6,045,469 A * 4/2000 Gleason ..... A63B 43/002 273/DIG. 20
D432,191 S * 10/2000 Nelson ..... D21/712
(Continued)

OTHER PUBLICATIONS

Office Action and Search Report for Portuguese Application No. 118186 dated Oct. 28, 2022, 8 pages.
(Continued)

*Primary Examiner* — Steven B Wong
(74) *Attorney, Agent, or Firm* — WOOD IP LLC

(57) ABSTRACT

Provided is a ball that includes a plurality of panels attached together to form a hollow structure. The hollow structure includes a head portion at a first end and a tail portion at a second end. The hollow structure is also characterized by a tapered profile in a longitudinal direction, such that a diameter of the head portion is greater than a diameter of the tail portion. The ball also includes a tubular duct (i) integrated within a center of the hollow structure and (ii) extending along a length of the hollow structure.

18 Claims, 6 Drawing Sheets

(56) References Cited

U.S. PATENT DOCUMENTS

| | | | | | |
|---|---|---|---|---|---|
| 6,132,282 | A * | 10/2000 | Camp | A63H 33/003 | 446/124 |
| 6,220,918 | B1 * | 4/2001 | Laronge | A63B 65/00 | 473/585 |
| 6,264,574 | B1 * | 7/2001 | Nelson | A63B 65/00 | 473/603 |
| 6,454,623 | B1 * | 9/2002 | Flatau | A63H 33/185 | 473/578 |
| 8,920,267 | B2 * | 12/2014 | Gable | A63H 33/185 | 473/569 |
| 9,408,779 | B2 * | 8/2016 | Stewart | A61J 9/0607 | |
| 9,561,402 | B2 * | 2/2017 | Fogarty | A63B 69/002 | |
| 2006/0046879 | A1 * | 3/2006 | Kelly | A63B 41/08 | 473/603 |
| 2011/0009218 | A1 * | 1/2011 | Wallach | A63B 43/002 | 473/594 |
| 2014/0080643 | A1 * | 3/2014 | Lin | A63B 43/002 | 473/598 |
| 2015/0005116 | A1 * | 1/2015 | Turner | A63B 37/12 | 473/595 |
| 2020/0206581 | A1 * | 7/2020 | Krysiak | A63B 41/08 | |

OTHER PUBLICATIONS

Order Duct-ball Product Information. [online]. Azorean FL, 2020 [retrieved on Oct. 28, 2022], 1 page. Retrieved from https://azoreanfl.com/product/duct-ball/.

* cited by examiner

BALL HAVING A TAPERED PROFILE AND INTEGRATED TUNNEL

CROSS-REFERENCE TO RELATED APPLICATIONS

This application claims the benefit of Portuguese Patent Application No. 20221000003347, filed Sep. 6, 2022, the contents of which are hereby incorporated by reference in its entirety.

TECHNICAL FIELD

The technical field relates generally to a ball. In particularly, a ball having a tapered profile and a tunnel integrated within the ball.

BACKGROUND

There are many types of balls designed for specific purposes in their corresponding sports. For example, in the game of American football, a ball (football) having two narrow ends and a wider middle portion is used for throwing the football from one player to another, as well as kicking the football from one team to another. When the football is thrown correctly, it performs a characteristic spiral motion. Additionally, when the football is kicked correctly, it performs a characteristic flipping motion.

Similarly, in the game of soccer, a soccer ball being completely spherical in shape is similarly used for throwing and kicking the soccer ball from one player to another, as well as scoring goals. As the soccer ball is kicked or thrown into the air, it performs a characteristic rotating motion.

The ability of the American football and the soccer ball to perform the motions mentioned above is essential for effectively carrying out the rules of American football and soccer, respectively.

Azorean football is a new sport that has been developed as a combination of American football and soccer. As with these sports, Azorean football also requires a ball that can be effectively thrown and/or kicked in accordance with the rules of the game.

For example, to effectively play Azorean football, it is necessary that the ball being used for the sport be capable of being easily gripped with one hand and maintaining a spiral while traveling through the air.

Additionally, according to the rules of the game, the Azorean football is allowed to hit the ground during multiple phases of the game. As a result, it is critical that the ball performs a predictable bouncing pattern after hitting the ground.

In contrast, when the American football is thrown, unless one throws with high precision and accuracy, the football will often perform a wobble motion while traveling through the air. Thus, throwing an American football requires a great amount of practice and expertise for it to achieve the characteristic spiral motion. Additionally, in instances in which the American football hits the ground, it bounces with an unpredictable bouncing pattern.

In regards to soccer, due to the shape and size of the soccer ball, it is more difficult to grip the ball with one hand when attempting to throw and catch it, as well as to predict its bouncing pattern once it hits the ground.

To solve the above-mentioned problems, it is desirable to provide a ball that has the combined characteristics of an American football and a soccer ball in order to achieve the performance characteristics necessary for playing the game of Azorean football.

SUMMARY OF THE INVENTION

The embodiments of the present disclosure provide a sports ball having a tapered profile and an integrated duct defining a tunnel spanning a length of the ball.

In one exemplary embodiment, a ball is provided that includes a plurality of panels attached together to form a hollow structure. The hollow structure includes a head portion at a first end and a tail portion at a second end. The hollow structure is also characterized by a tapered profile in a longitudinal direction, such that a diameter of the head portion is greater than a diameter of the tail portion. The ball also includes a tubular duct (i) integrated within a center of the hollow structure and (ii) extending along a length of the hollow structure.

In another exemplary embodiment, a ball is provided that includes a head portion at a first end of the ball and a tail portion at a second end of the ball. Furthermore, a diameter of the ball decreases along a length of the ball from the head portion to the tail portion. The ball also includes a tubular duct that is integrated within a center of the hollow structure and extends from the head portion to the tail portion.

The foregoing has broadly outlined some of the aspects and features of various embodiments, which should be construed to be merely illustrative of various potential applications of the disclosure. Other beneficial results can be obtained by applying the disclosed information in a different manner or by combining various aspects of the disclosed embodiments. Accordingly, other aspects and a more comprehensive understanding may be obtained by referring to the detailed description of the exemplary embodiments taken in conjunction with the accompanying drawings, in addition to the scope defined by the claims.

Figure 1:
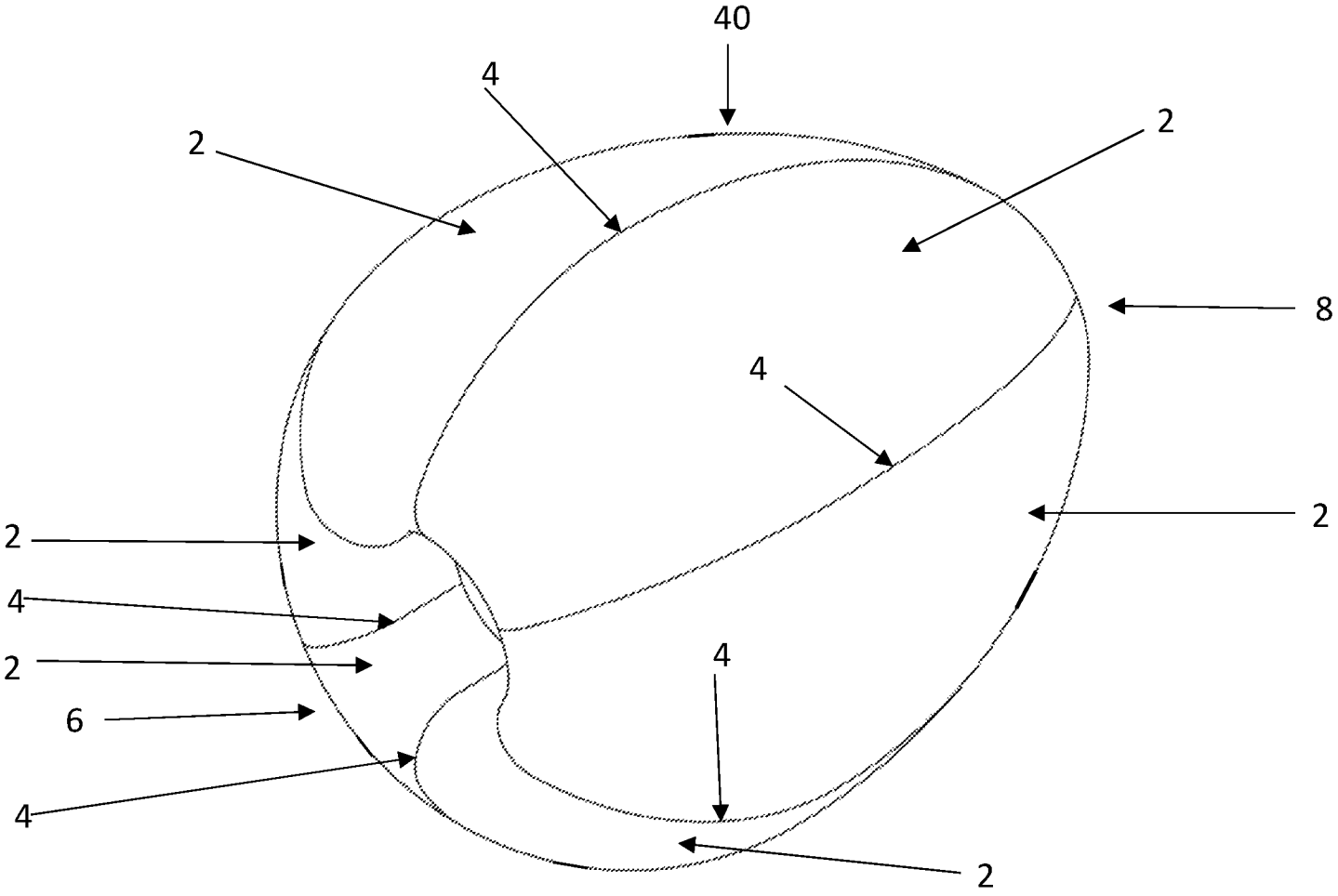
FIG. 1 is an isometric view showing the head portion of a ball according to one or more exemplary embodiments of the present invention.

The drawings are only for purposes of illustrating preferred embodiments and are not to be construed as limiting the disclosure. Given the following enabling description of the drawings, the novel aspects of the present disclosure should become evident to a person of ordinary skill in the art. This detailed description uses numerical and letter designations to refer to features in the drawings. Like or similar designations in the drawings and description have been used to refer to like or similar parts of embodiments of the invention.

DETAILED DESCRIPTION OF EXEMPLARY EMBODIMENTS

As required, detailed embodiments are disclosed herein. It must be understood that the disclosed embodiments are merely exemplary of various and alternative forms. As used herein, the word "exemplary" is used expansively to refer to embodiments that serve as illustrations, specimens, models, or patterns. The figures are not necessarily to scale and some features may be exaggerated or minimized to show details of particular components. In other instances, well-known components, systems, materials, or methods that are known to those having ordinary skill in the art have not been described in detail in order to avoid obscuring the present disclosure. Therefore, specific structural and functional details disclosed herein are not to be interpreted as limiting, but merely as a basis for the claims and as a representative basis for teaching one skilled in the art.

FIG. 1 is an isometric view showing the head portion of a ball according to one or more exemplary embodiments of the present invention. As shown FIG. 1, ball is made up of panels 2 that are stitched together via stitches 4. The head portion 6 of ball 40 is rounded in shape and is larger in diameter compared to its tail portion 8.

Ball 40 is designed such that head portion 6 always hits the ground first after being thrown or kicked, and the round shaped of head portion 6 helps to ensure that the bouncing behavior of ball 40 is predictable.

Figure 2:
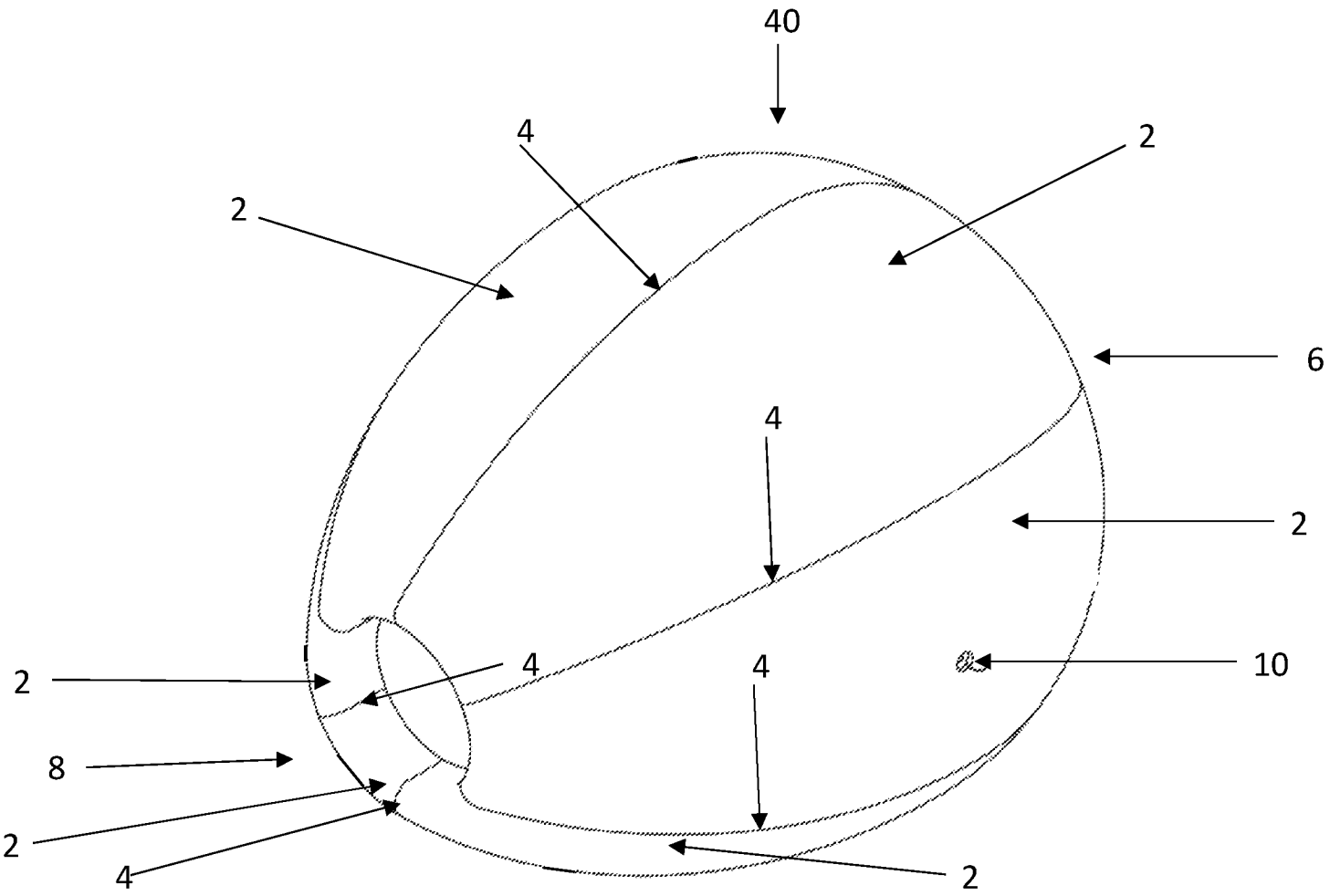
FIG. 2 is an isometric view showing the tail portion of a ball according to one or more exemplary embodiments of the present invention.

FIG. 2 is an isometric view showing the tail portion of a ball according to one or more exemplary embodiments of the present invention. As shown in FIG. 2, tail portion 8 of ball 40 is more elongated in shape and has a smaller diameter compared to head portion 6. More specifically, ball 40 forms a tapered profile extending from head portion 6 to tail portion 8, resulting in a tear drop-shaped structure. This aerodynamic feature allows for one to more easily grip ball 40 in one's hand, as well as catch it.

Additionally, ball 40 includes inflation valve aperture 10 located centrally on one of the panels 2. The inflation valve aperture 10 is of the conventional types well-known in the art.

Figure 3:
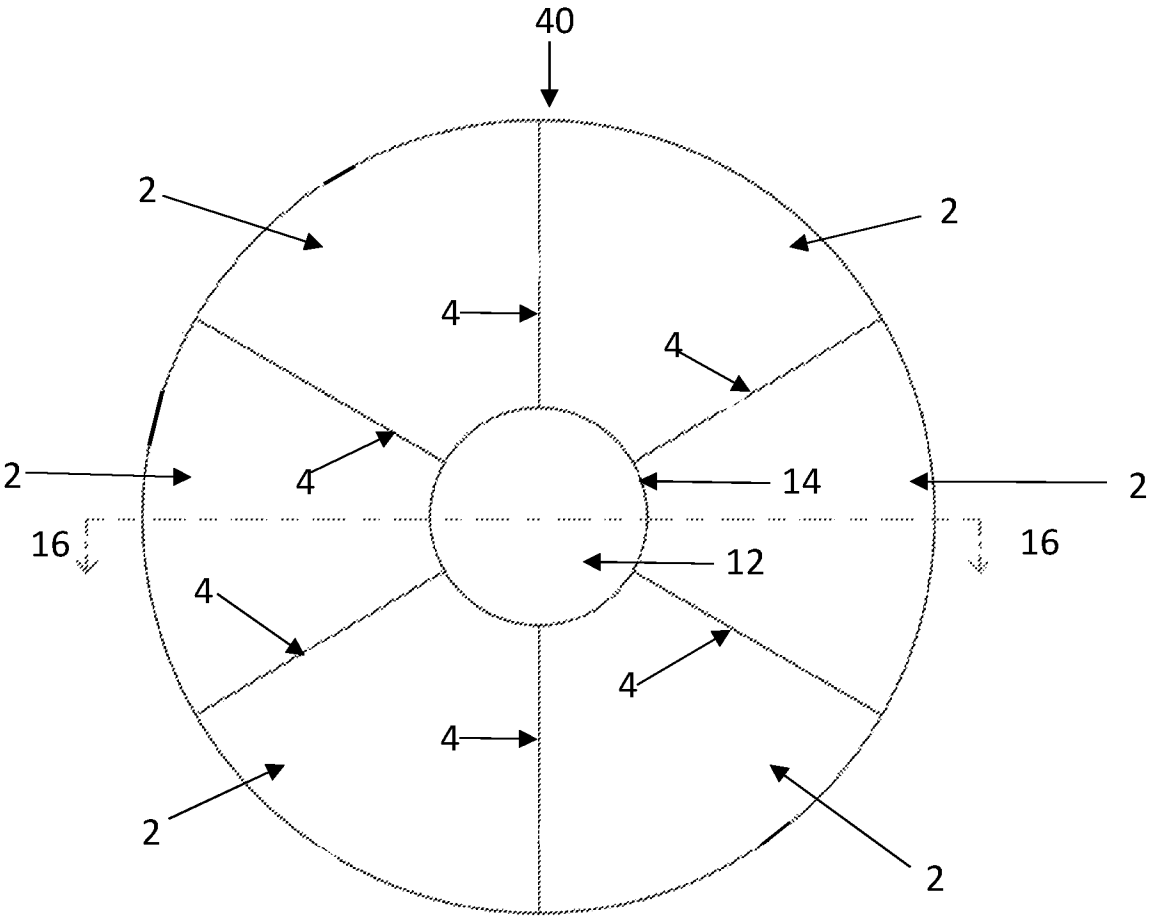
FIG. 3 is front view of a ball according to one or more exemplary embodiments of the present invention.

FIG. 3 is a front view of a ball according to one or more exemplary embodiments of the present invention. As shown in FIG. 3, ball 40 includes a tunnel 12 located in the center of ball 40. Tunnel 12 reduces the frontal surface of ball 40 but only when ball 40 is thrown such that longitudinal axis 16 is perpendicular to the throwing direction.

Figure 4:
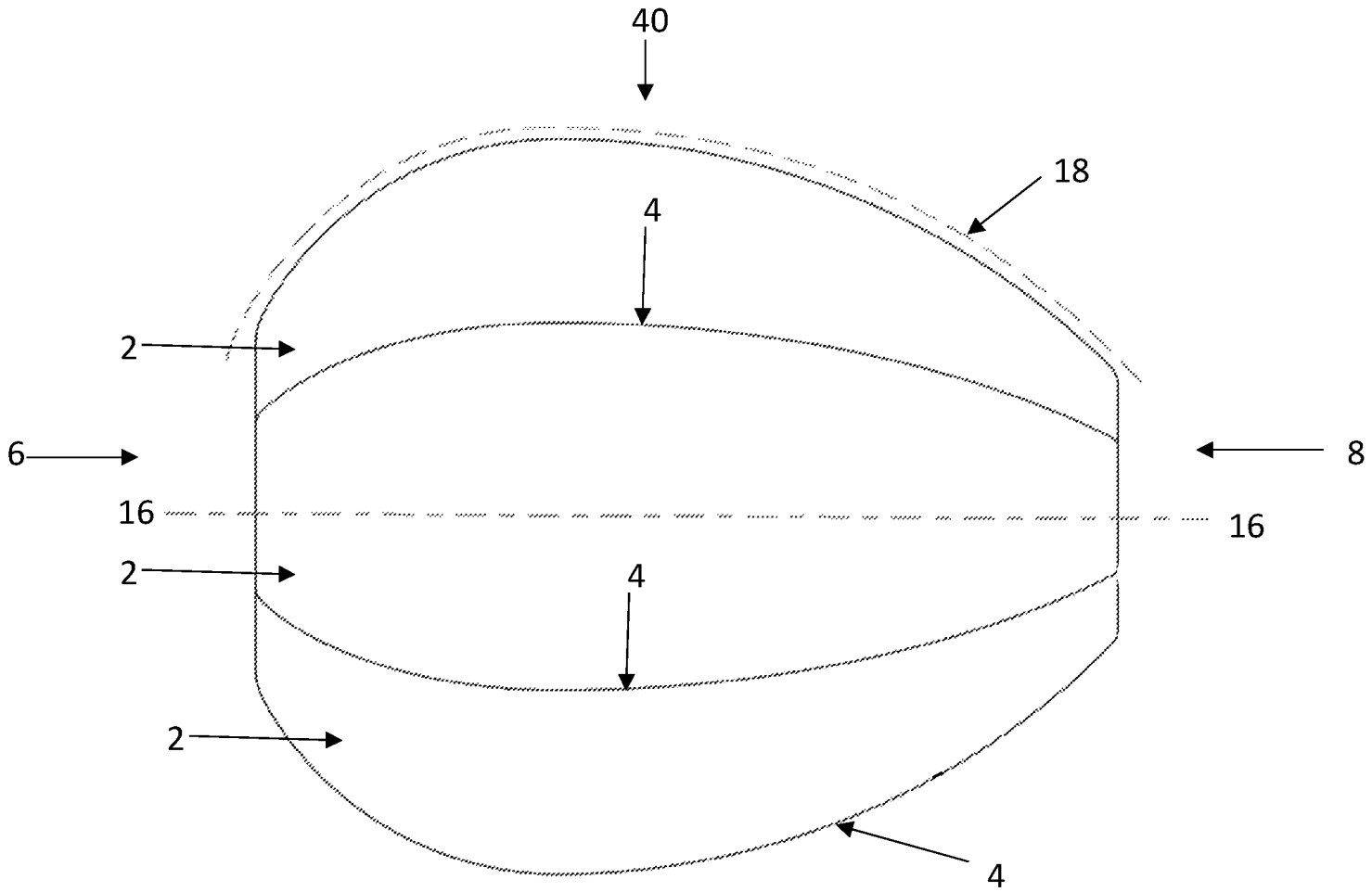
FIG. 4 is a side view of a ball according to one or more exemplary embodiments of the present invention.

FIG. 4 is a side view of a ball according to one or more exemplary embodiments of the present invention. As mentioned earlier, ball 40 has a tear drop shape in which head portion 6 more is rounded and has a larger diameter than the more elongated tail portion 8. This results in tapered profile 18. Tapered profile 18 is based on the NACA airfoil design, executed as a 360 degree revolve in longitudinal axis 16 to achieve an aerodynamic shape.

Additional details regarding a ball according to the invention will now be described with reference to FIG. 5.

Figure 5:
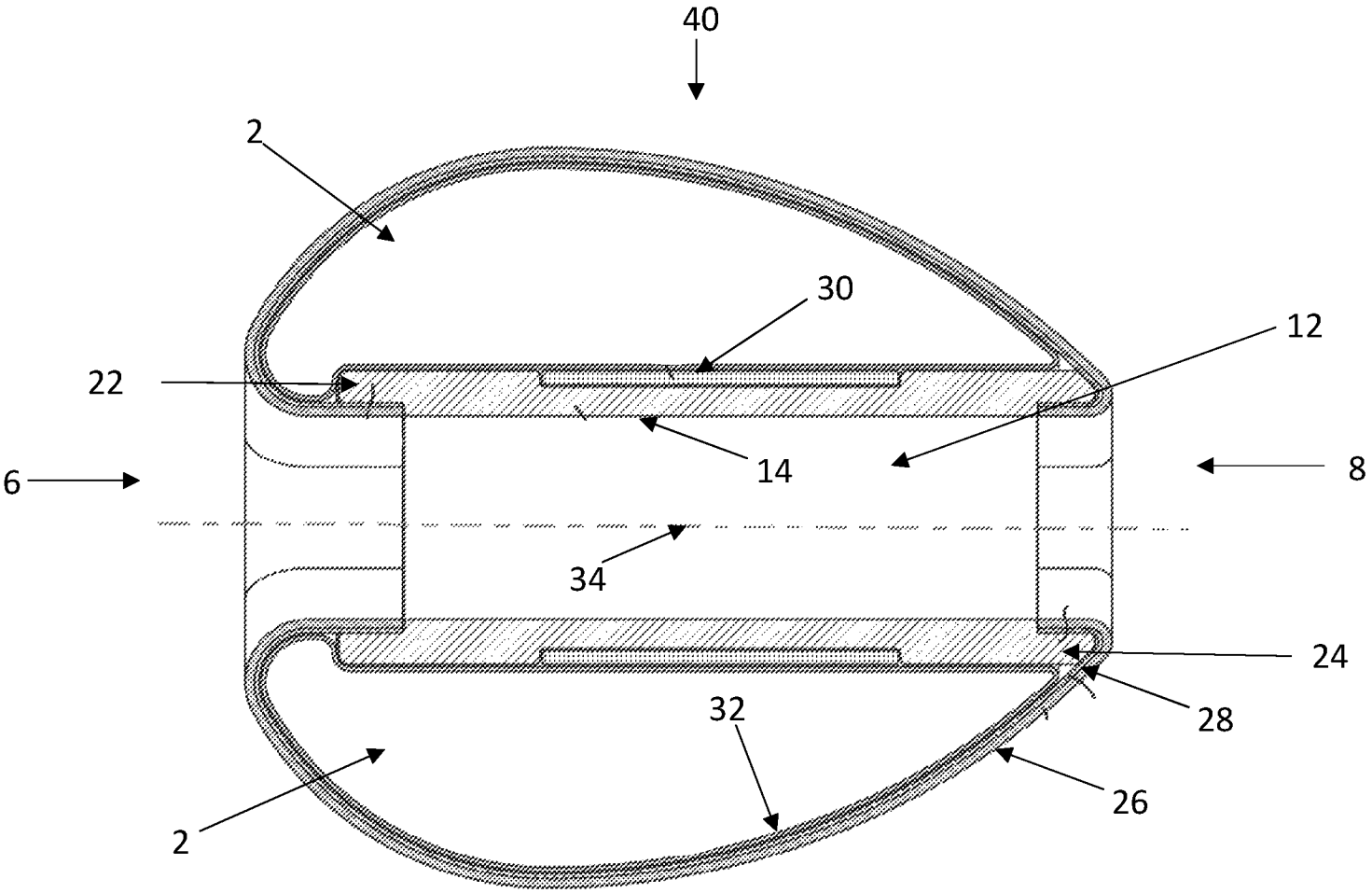
FIG. 5 is a detailed view of a ball along the longitudinal axis shown in FIGS. 3 and 4 according to one or more exemplary embodiments of the present invention.

FIG. 5 is a detailed view of a ball along the longitudinal axis shown in FIGS. 3 and 4 according to one or more exemplary embodiments of the present invention. As mentioned earlier, ball 40 includes tunnel 12. Tunnel 12 begins at head portion 6 where ball 40 has a more rounded, spherical shape, to achieve a more precise and predictable bouncing pattern.

As shown in FIG. 5, tunnel 12 is a tubular structure and is integrated within the center of ball 40. More specifically, tunnel 12 extends in a longitudinal direction from head portion 6 to tail portion 8 and is of a constant diameter in the longitudinal direction.

In an alternative embodiment, tunnel 12 may vary in diameter. For example, tunnel 12 may have a funnel-like shape such that tunnel 12 would have a larger diameter at head portion 6 compared its diameter at tail portion 8.

Ball 40 also includes reinforced duct 14, which defines tunnel 12 and allows tunnel 12 to maintain its original shape when ball 40 is being pressurized. Additionally, as can be seen in FIG. 3, reinforced duct 14 is attached to panels 2 via stitches 4.

According to one embodiment, reinforced duct 14 may be made of a foam material.

According to another embodiment, the foam material may be made from a foam cylinder having a hardness of about 40-80 shore A.

Reinforced duct 14 also includes front end 22 located at head portion 6 and back end 24 located at tail portion 8. As shown in FIG. 5, panels 2 made of outer skin 26 are attached to reinforced duct 14 at front end 22 and back end 24.

In some embodiments, outer skin 26 may be made of a rubber material. More specifically, outer skin 26 may include a two-layer fabric having a rubber adhesive, which helps to improve the flight of ball 40.

Figure 6:
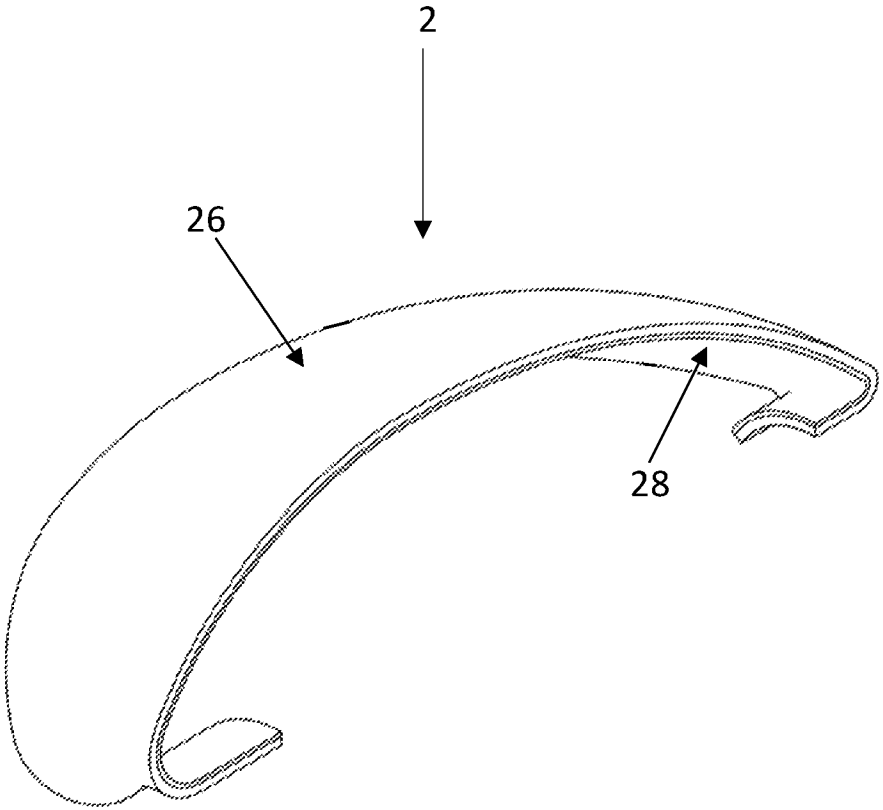
FIG. 6 is an example of a panel assembly of a ball shown in FIGS. 1-5 according to one or more exemplary embodiments of the present invention.

Additionally, an example of a panel assembly of a ball according to one or more exemplary embodiments shown in FIG. 6 illustrates the overall structure of panels 2, having curved ends that attach to front end 22 and back end 24 of duct 14.

As shown in FIGS. 5 and 6, panels 2 also include foam lining 28 which is attached to the inner portion of panels 2. Panels 2 can be stitched together via stitches 4 either through outer skin 26 only or through outer skin 26 and foam lining 28.

Reinforced duct 14 also includes tunnel reinforcement material 30 which is disposed around the outer surface of the middle portion of reinforced duct 14 as shown in FIG. 5, for the purpose maintaining the structural integrity of reinforced duct 14 while ball 40 is being kicked or thrown, and to protect one's hands from injury when catching ball 40. Tunnel reinforcement material 30 is made of a stronger but harder material than duct 14.

According to one embodiment, tunnel reinforcement material 30 may be added to the inside of duct 14.

According to another embodiment, tunnel reinforcement material 30 may be added to a section of duct 14 other than its middle portion.

Ball 40 also includes bladder 32, which extends around the outer surface of reinforced duct 14 and the inner surface of panels 2, resulting in a space between the exterior portion of reinforced duct 14 and the interior portion of panels 2 for inflating ball 40. Thus, the shape of bladder 32 follows the characteristic tear drop shape of ball 40.

Bladder 32 also includes an integrated tunnel 34 in the longitudinal direction from head portion 6 to tail portion 8.

As mentioned earlier, and as shown in FIG. 5, bladder 32 extends around the outer surface of reinforced duct 14. As a result, head portion 6 of ball 40 is formed by panels 2 and bladder 32. This construction contributes to the bouncing behavior of ball 40 being more predictable.

According to one embodiment, bladder 32 may be a separate component assembled into ball 40.

According to another embodiment, bladder 32 may be an integral component of reinforced duct 14.

The ball according to the embodiments of the present invention permits one the ability to accurately predict the bouncing pattern of the ball, while being able to throw and kick the ball to achieve a characteristic spiral motion.

This written description uses examples to disclose the invention, including the best mode, and also to enable any person skilled in the art to practice the invention, including making and using any devices or systems and performing any incorporated methods.

The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A ball comprising:

a plurality of panels attached together to form a hollow structure comprising a head portion at a first end of the hollow structure and a tail portion at a second end of the hollow structure;

wherein the hollow structure is characterized by a tapered profile in a longitudinal direction, such that a maximum diameter of the head portion is greater than a maximum diameter of the tail portion; and a tubular duct (i) integrated within a center of the hollow structure (ii) extending along a length of the hollow structure and (iii) comprising a tunnel reinforcement material disposed around an outer surface of a middle portion of the tubular duct, the tunnel reinforcement material being made of a stronger and harder material than the tubular duct.

2. The ball of claim 1, wherein the head portion has a rounded shape.

3. The ball of claim 1, wherein the tail portion has an elongated shape.

4. The ball of claim 1, wherein the tubular duct defines a tunnel.

5. The ball of claim 4, wherein the tunnel extends in the longitudinal direction from the head portion to the tail portion.

6. The ball of claim 5, wherein the tunnel is of a constant diameter throughout a length of the tunnel.

7. The ball of claim 5, wherein the tubular duct is attached to the plurality of panels via a plurality of stitches.

8. The ball of claim 1, wherein the tubular duct is made of a foam material.

9. The ball of claim 8, wherein the foam material is made from a foam cylinder having a hardness of 40-80 shore A.

10. The ball of claim 8, wherein the tubular duct further comprises a front end located at the head portion and a back end located at the tail portion.

11. The ball of claim 10, wherein the plurality of panels are attached to the tubular duct via the front end and the back end.

12. The ball of claim 11, wherein the plurality of panels further includes an outer skin made of a rubber material.

13. The ball of claim 12, wherein the rubber material is a 2-layer fabric having a rubber adhesive.

14. The ball of claim 1, further comprising a bladder extending around an outer surface of the tubular duct and an inner surface of the plurality of panels.

15. The ball of claim 14, wherein the head portion is formed by the plurality of panels and the bladder.

16. The ball of claim 15, wherein the bladder is a separate component of the ball.

17. The ball of claim 15, wherein the bladder is an integral component of the tubular duct.

18. A ball comprising:

a head portion at a first end of the ball;

a tail portion at a second end of the ball;

wherein, a diameter of the ball decreases along a length of the ball from the head portion to the tail portion such that a maximum diameter of the head portion is greater than a maximum diameter of the tail portion; and a tubular duct (i) integrated within a center of the ball (ii) extending from the head portion to the tail portion and (iii) comprising a tunnel reinforcement material disposed around an outer surface of a middle portion of the tubular duct, the tunnel reinforcement material being made of a stronger and harder material than the tubular duct.

* * * * *